US006179437B1

(12) United States Patent
Hardy et al.

(10) Patent No.: US 6,179,437 B1
(45) Date of Patent: Jan. 30, 2001

(54) FOLDABLE, UNITARY STAMPED METAL CANDLE HOLDER HAVING DECORATIVE CUTOUTS

(75) Inventors: Christopher Hardy, Springfield; David Maxwell, Chicago, both of IL (US); Emily Vassos, Providence, RI (US)

(73) Assignee: Design Ideas, Ltd., Springfield, IL (US)

( * ) Notice: Under 35 U.S.C. 154(b), the term of this patent shall be extended for 0 days.

(21) Appl. No.: 09/206,447

(22) Filed: Dec. 7, 1998

(51) Int. Cl.[7] ..... F21V 19/00; F21V 1/06

(52) U.S. Cl. ..... 362/162; 362/181; 362/352; 29/513

(58) Field of Search ..... 362/162, 172, 362/181, 352, 810, 367, 186, 362; 29/509, 513; 446/478, 147, 148

(56) References Cited

U.S. PATENT DOCUMENTS

| | | | | |
|---|---|---|---|---|
| 27,924 | | 4/1860 | Morley | 362/162 |
| 277,401 | | 5/1883 | Atkinson | 220/684 |
| 314,725 | | 3/1885 | Ronner | 362/162 |
| 383,175 | | 5/1888 | Gardner | 229/198.2 |
| 890,193 | * | 6/1908 | Stonebridge | 362/162 |
| 932,772 | * | 8/1909 | Fleck | 362/162 |
| 1,120,024 | * | 12/1914 | Carney | 362/162 |
| 1,650,052 | | 11/1927 | Smith | 229/164.1 |
| 3,246,828 | | 4/1966 | Branscum et al. | 220/4.34 |
| 4,000,595 | * | 1/1977 | Burton | 52/716.1 |
| 4,422,231 | * | 12/1983 | Braybrook | 29/509 |
| 4,907,140 | | 3/1990 | Overstreet | 362/162 |
| 5,264,996 | | 11/1993 | Bele, Jr. et al. | 362/162 |

* cited by examiner

*Primary Examiner*—Alan Cariaso
*Assistant Examiner*—Ronald E. DelGizzi
(74) *Attorney, Agent, or Firm*—Saidman DesignLaw Group

(57) ABSTRACT

A unitary metal candle holder including a base and a plurality of panels integrally hinged to the base by a plurality of straps. The panels, which are shaped to simulate thematic scenes, may be folded by hand and remain upright without additional reinforcement. A retail consumer may purchase the candle holder in its flat, unfolded state, and mail it in a flat envelope to, for example, a gift recipient who, as the end user, folds the panels and uses the product.

23 Claims, 5 Drawing Sheets

FOLDABLE, UNITARY STAMPED METAL CANDLE HOLDER HAVING DECORATIVE CUTOUTS

BACKGROUND OF THE INVENTION

1. Field of The Invention

The present invention relates to a candle holder, and more particularly, to a candle holder formed from a stamped metal blank.

2. Description of Related Art

Candle holders of all shapes and sizes are known in the art. By definition, candle holders are designed to perform a function—to hold one or more candles. In addition, most candle holders are also designed to be decorative. As a result, candle holders are very popular household items and have long been favorites of gift givers. Unfortunately, many of the candle holders of the prior art are often bulky and difficult to store or ship.

Attempts have been made to provide candle holders or lanterns that can be disassembled or collapsed to allow for easier storage and transport. A description of a representative sample of the prior art follows.

The patent to Morley, U.S. Pat. No. 27,924 discloses a lantern having a top, hinged sides, and a bottom portion. The bottom is designed to be removed and the sides spread outwardly, allowing the lantern to be stored and shipped in a flattened position. The lantern taught in Morely is deficient because it is complex and expensive to produce. In addition, collapsing the lantern requires removal of several retaining rods, which could easily be lost.

Atkinson, U.S. Pat. No. 277,401, stamps a metal blank to form a box comprising a base and four connected sides, each of which has side flanges. When bent along fold lines, the four sides extend upwardly from the base, where their flanges are secured together by means of clips. The box taught by Atkinson requires extensive bending of sides and flanges and includes the ever-present possibility of losing the clips.

Ronner, U.S. Pat. No. 314,725, discloses a lantern having a base, sides, and top hinged together by a disparate material, e.g., metal, leather, muslin, etc., to allow folding it "flat." The lantern is held in its opened shape by means of interlocking recessed edges. The assembly time for this lantern is exorbitant, and "flat" means three sides thick, hardly facilitating shipping and storing.

Gardner, U.S. Pat. No. 383,175, provides a box having mortise and tenon joints on the confronting edges of the sides which are folded upwardly from a flat configuration to form the box. Gardner requires compressing and/or welding the joints together, an obviously labor-intensive construction process.

The patents to Overstreet, U.S. Pat. No. 4,907,140, and Bele, Jr. et al., U.S. Pat. No. 5,264,996, show collapsible lanterns made of stiff paperboard or cardboard. The lanterns in both Overstreet and Bele, Jr, et al. include side panels that are joined to one another along their entire height by a fold line or crease. The lanterns are formed by inwardly folding four side panels, along the fold lines or creases, and engaging at least one tab-and-slot combination. The lanterns taught in Overstreet and Bele, Jr. et al. are deficient because they must be formed of stiff paperboard or cardboard in order to enable the side panels to be inwardly folded. Use of paperboard or cardboard is complex and expensive because such materials must be coated with a flame retardant substance. In addition, such designs are relatively difficult to assemble.

OBJECTS AND SUMMARY OF THE INVENTION

It is an object of the present invention to provide a candle holder that can be shipped and stored in a substantially flat position.

It is a further object of the present invention to provide a candle holder that is simple and inexpensive to manufacture.

It is yet another object of the present invention to provide a candle holder that can be easily erected and collapsed.

It is yet another object of the present invention to provide a candle holder that includes side panels which do not require additional members, such as interacting tabs and slots or wires or pins, in order to be self-supporting.

The foregoing and other objects are achieved in accordance with the present invention through the provision of a candle holder formed from a unitary stamped metal blank. The candle holder includes side panels and end panels, each panel being connected to a centrally located base by a plurality of tabs or straps. The candle holder is erected by upwardly folding the panels, each panel being maintained in a substantially upright position by the resistance of the metal straps to being bent, i.e., the bending memory of the straps. The base is adapted to receive a tea-light candle thereon. Each panel preferably has a decorative shape and includes one or more cutouts therein which simulate the appearance of a building, trees or the like, and allow light from the candle to shine therearound and therethrough.

BRIEF DESCRIPTION OF THE DRAWINGS

The present invention will be more fully appreciated as the same becomes better understood from the following detailed description of the present invention when viewed in conjunction with the accompanying drawings, in which.

DETAILED DESCRIPTION OF THE PREFERRED EMBODIMENTS

Figure 1:
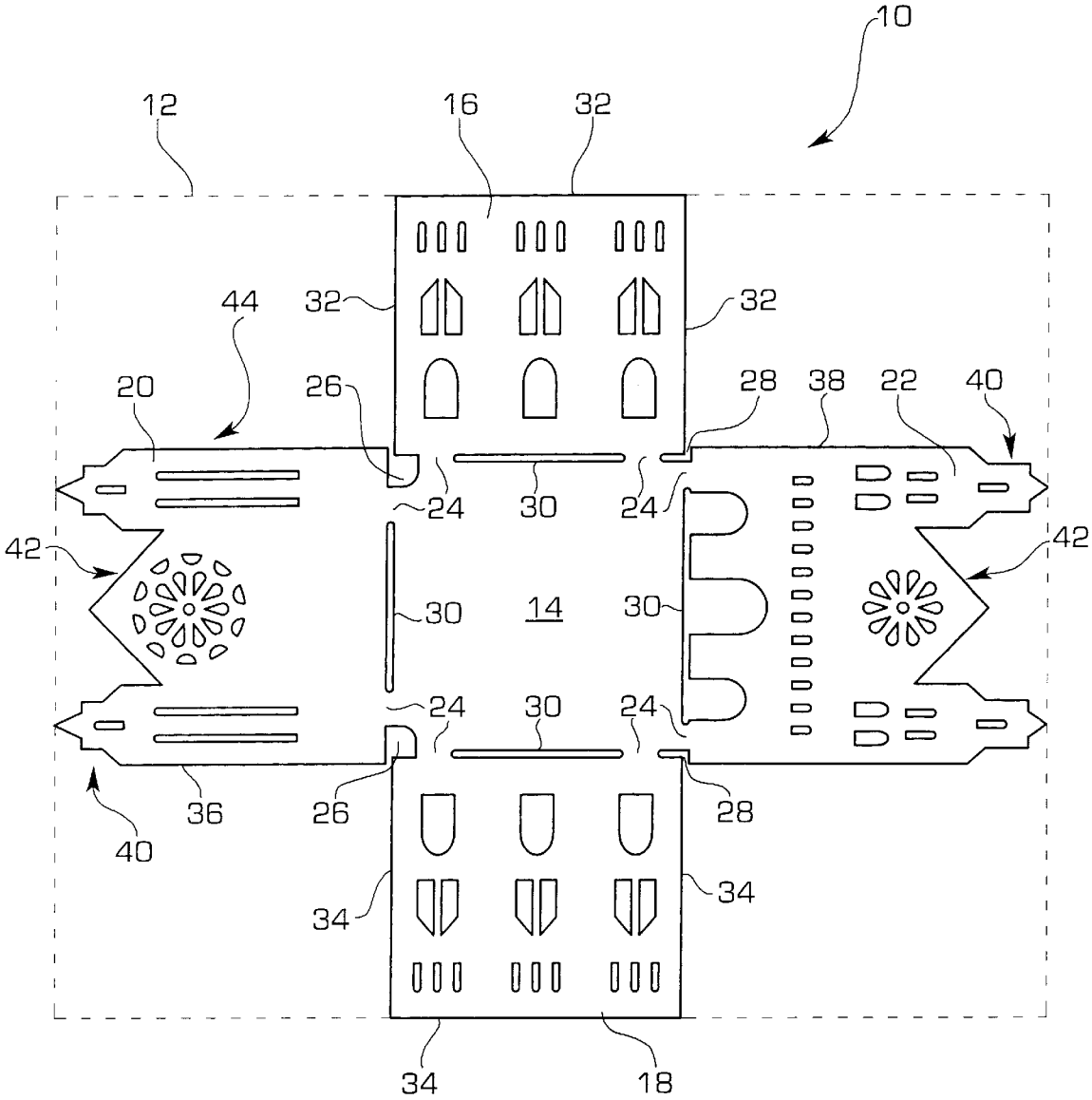
FIG. 1 is a top view of a first embodiment of the candle holder of the present invention, showing the candle holder in an unfolded state.

Referring now to FIG. 1, reference numeral 10 generally refers to a preferred embodiment of a foldable candle holder of the present invention. Candle holder 10 is made from a stamped metal blank 12, and includes base 14, two side panels 16 and 18, and two end panels 20 and 22.

Blank 12, the original form of which is indicated by dashed lines, comprises an integral, thin sheet of metal which has a rectangular dimension large enough to encompass the design of the candle holder intended to be made. Blank 12 is thin, having a preselected gauge; any desired thickness may be used, consonant with the function, design, and intended environment of use for the candle holder. In the best mode presently contemplated for the present invention, the thickness of metal blank 12 is approximately 0.30 mm±0.02 mm. Blank 12 is stamped by a conventional stamping process to remove selected portions of the metal sheet. The remaining portions provide the outlines and details of whatever scene is created by the designer. Where desired, blank 12 may be coated with a suitable material, such as an electrostatically applied powdercoat of epoxy, colored to fit the scene depicted. In the preferred form, the scene stamped from blank 12 is approximately 6" by 6" for a purpose which will become clear hereinafter.

Base 14 is preferably square, as shown, since that configuration best fits tea candles most attractively. However, a rectangular base, sized to receive candle arrangements having an elongated support, or a plurality of tea candles linearly aligned, staggered, or arranged in a matrix, is within the purview of the present invention.

Figure 2:
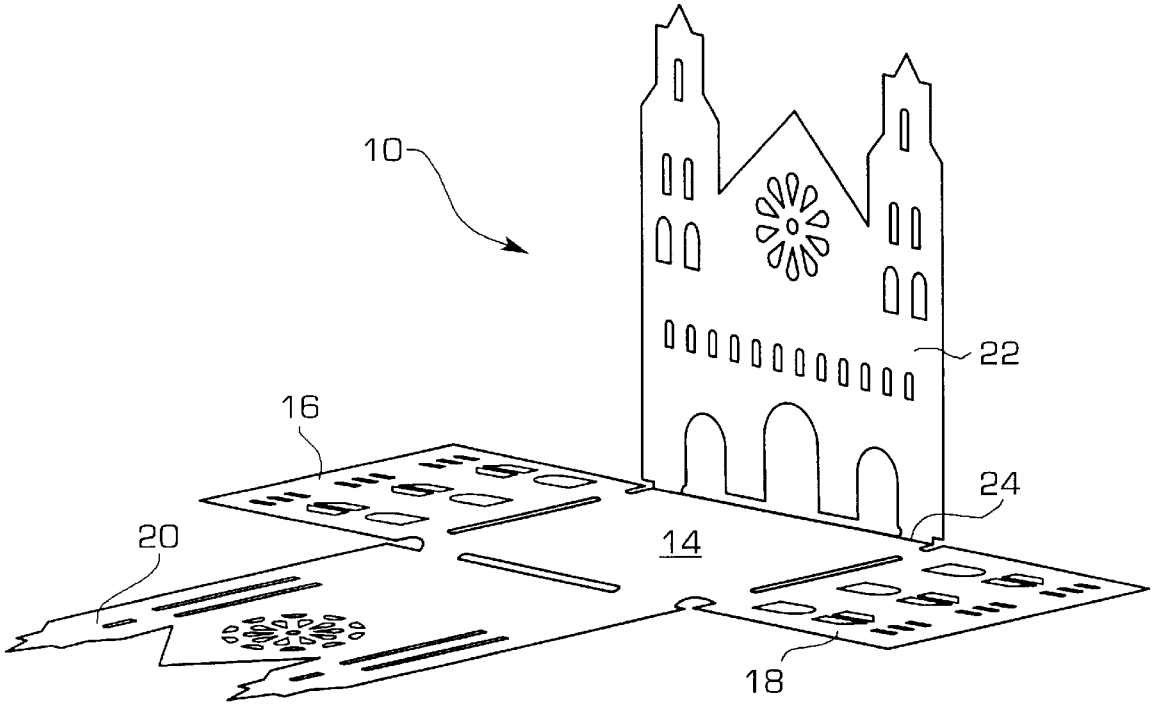
FIG. 2 is a perspective view of the first embodiment showing one end panel of the candle holder upwardly folded.
Figure 3:
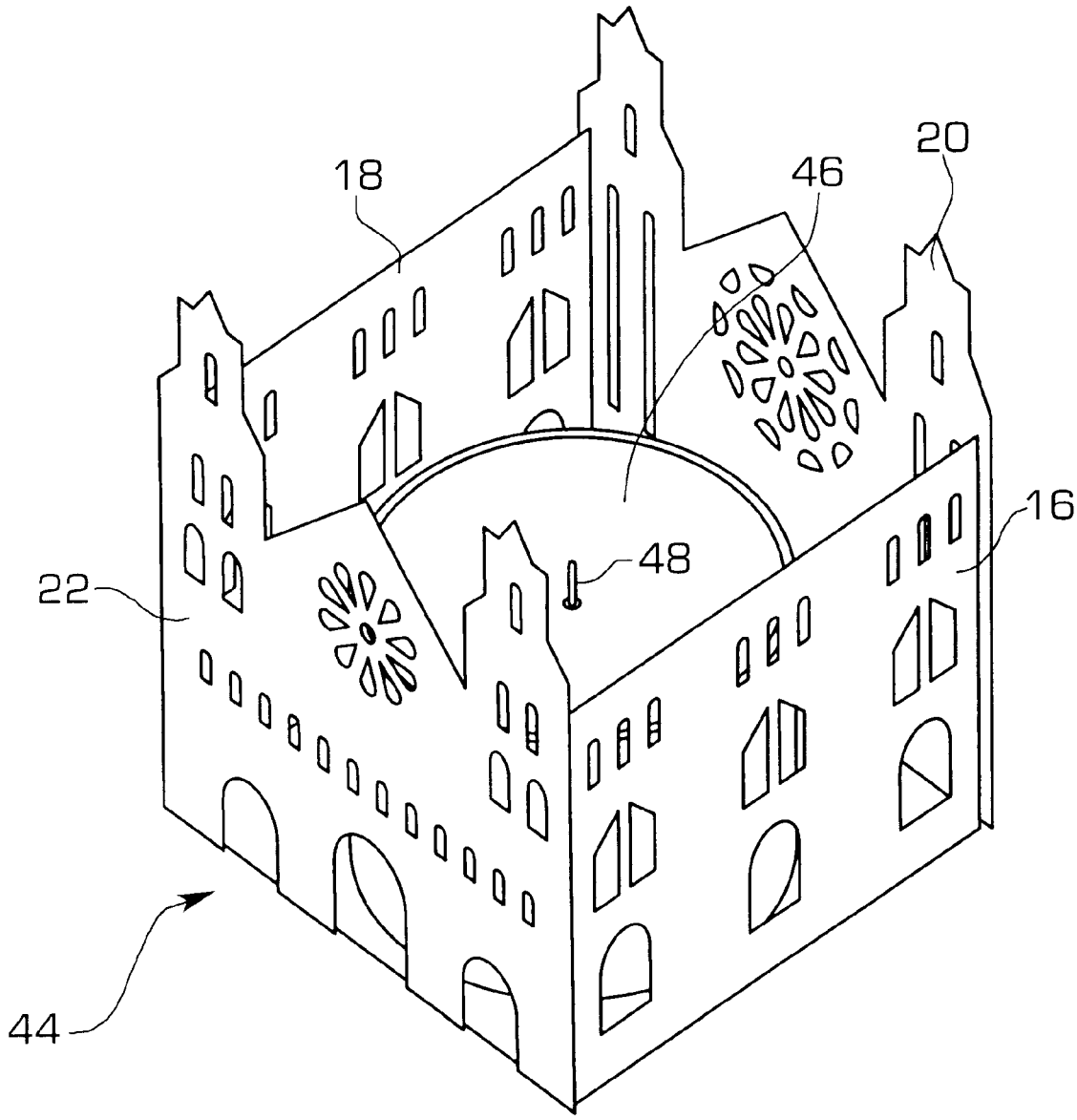
FIG. 3 is a perspective view of the first embodiment shown in a completely folded state with a candle resting therein.

Panels 16, 18, 20, and 22 are located adjacent to base 14, each being positioned on a different side of base 14. Side panel 16 is located opposite side panel 18 and end panel 20 is located opposite end panel 22. (The modifiers "side" and "end" are a convenient artifice based upon the scene depicted. For example, the scene represented in FIGS. 1–3 is of a building having "side" walls and front and back "ends". The forest scene represented in FIGS. 4–5 has no such identifiable characteristics.) Each of the panels 16–22 are connected to base 14 by integral metal tabs or straps 24, shown as two per panel but obviously could be any number which does not impair the functioning of the straps, to be explained shortly. Straps 24 are delineated by stamping out corner cut-outs, which can be of any desired shape, two such forms 26 and 28 being shown diagrammatically, and by stamping out slots 30, which also define the edges of base 14. Straps 24 facilitate the bending of the panels from their flat position to their upright position. If desired, straps 24 may be creased collinearly with edges 30 to further aid in bending the panels.

Base 14, panels 16–22, and straps 24 are integral with each other, the rest of blank 12 having been removed by the stamping of the original sheet metal blank 12. They are recognizable as separate identities, due to their shapes and orientations relative to the remaining structures. Because they are separately named in this description, based on their individual shapes and functions, it should not be assumed that they are in fact separate items which are brought together by assembly. Being a unitary structure, no assembly is required nor desired.

The exposed three sides of panels 16–22 are preferably shaped according to the part they play in the final scene. In the example shown in FIG. 1, the side edges 32 and 34 of panels 16 and 18, respectively, are rectilinear, inasmuch as they form the walls of a cathedral. Side edges 36 and 38 of panels 20 and 22, however, appear as the outline of the front and back of the cathedral, including twin spires 40 and an intermediate gable 42.

Interior of the side edges, panels 16, 18, 20, and 22 preferably include cutouts 44, referenced only generally, to create the appearance of, for example, windows and doors opening into the cathedral. When a candle is placed behind cutouts 44, the light will shine therethrough.

One of the benefits of candle holder 10 is that in the unfolded state shown in FIG. 1 wherein it is flat, thin, and of relatively small dimensions, it can be stored and shipped easily to wholesalers, retailers, and, importantly, the ultimate consumer. For example, a large number of them can be shipped to wholesalers and retailers at a low cost.

It will be recalled that the preferred dimensions of the flat scene is approximately six inches square, designed so as to fit in greeting card-sized envelopes. This is an important marketing feature, for each flat candle holder can serve as a gift item to be sold individually and unassembled to a retail consumer and which is sized so as to be sent by such consumer to a recipient in a flat envelope as, or with, a greeting card. Thus, the person who assembles the candle holder by folding up the sides thereof is the ultimate user, typically a gift recipient.

The scene stamped onto blank 12 can, of course, be designed to find correspondence with the theme or event being celebrated, whether it be a birthday, no graduation, or a religious holiday. The cathedral seen in FIGS. 1–3, for example, may symbolize a wedding, a first communion, a christening, or a baptism, to name just a few. Other thematic scenes will suggest themselves to a person of ordinary skill in the art.

FIG. 2 shows the first step of turning stamped blank 12, as shown in FIG. 1, into a full-fledged candle holder 10. Blank 12 is made of a relatively heavy gauge metal. As a consequence, each portion thereof, including straps 24, tend to retain their shapes. When flat, candle holder 10 naturally resists bending. When bent upright, a panel tends to stay in the position to which it was bent, due to the memory retention characteristics of straps 24. In FIG. 2, end panel 22 is shown folded into a substantially upright position, a position in which it will remain until forcibly moved to another position. There is no need for any of the additional members required by the prior art, such as wire rods and loops (Morley, Branscum et al.), separate clips (Atkinson), welded mortice and tenon joints (Gardner), or tabs and slots (Overstreet, Bele, Jr. et al.). This is an advance in the art over prior stamped candle holders and boxes, such as those discussed above. The instant candle holder does not require additional material nor additional assembly time since the metal of straps 24 is sufficient to maintain panels such as end panel 22 in a substantially upright position without further reinforcement.

FIG. 3 shows candle holder 10 in a fully assembled and folded position, with panels 16, 18, 20, and 22 being substantially upright. A tea candle 46 has been placed on base 14. When wick 48 is lit, the light generated thereby will shine through cutouts 44 producing a decorative light display.

Figure 4:
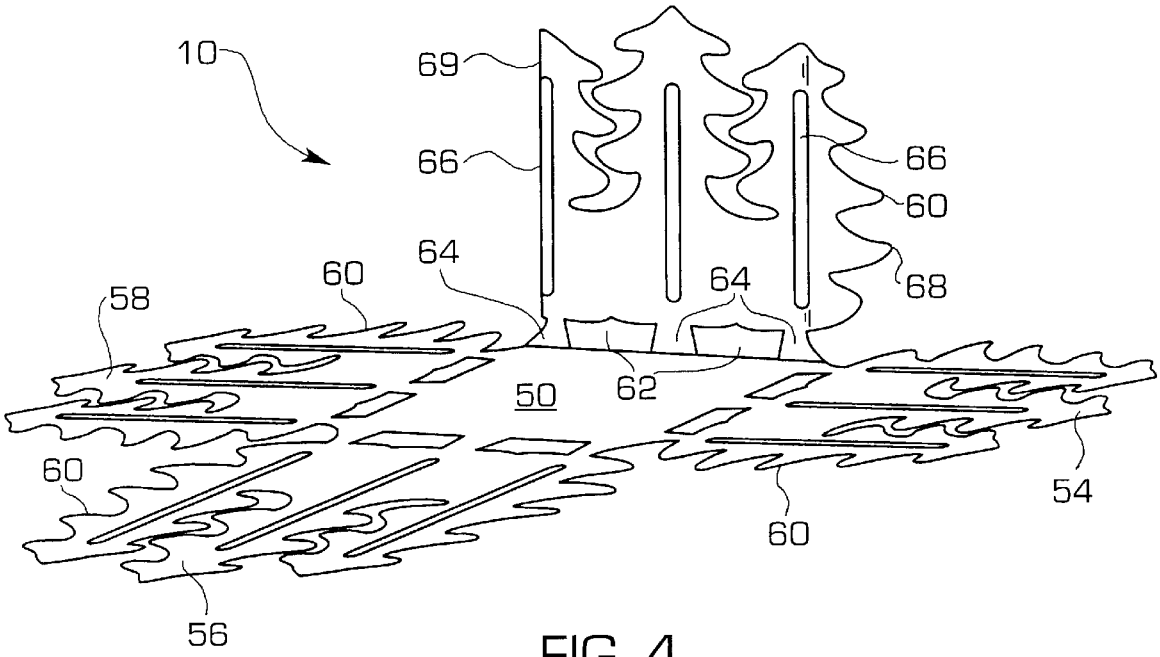
FIG. 4 is a perspective view of a second embodiment of the candle holder of the present invention showing one panel upwardly folded.

FIG. 4 illustrates the versatility of candle holder 10. A woodland scene is formed by the selected outline and cutouts of base 50 and side panels 52, 54, 56, and 58. Each of the side panels is stamped with the outlines 60 of pine trees with cutouts 62 delineating straps 64. Vertical cutouts 66 are suggestive of the trunks of the trees, and also provide a means for allowing the branches 68 outboard of side 52 to be bent outwardly using cutouts 66 as an axis. The upper left tree 69 in FIG. 4 has had its branches bent outwardly for additional decorative effect.

Figure 5:
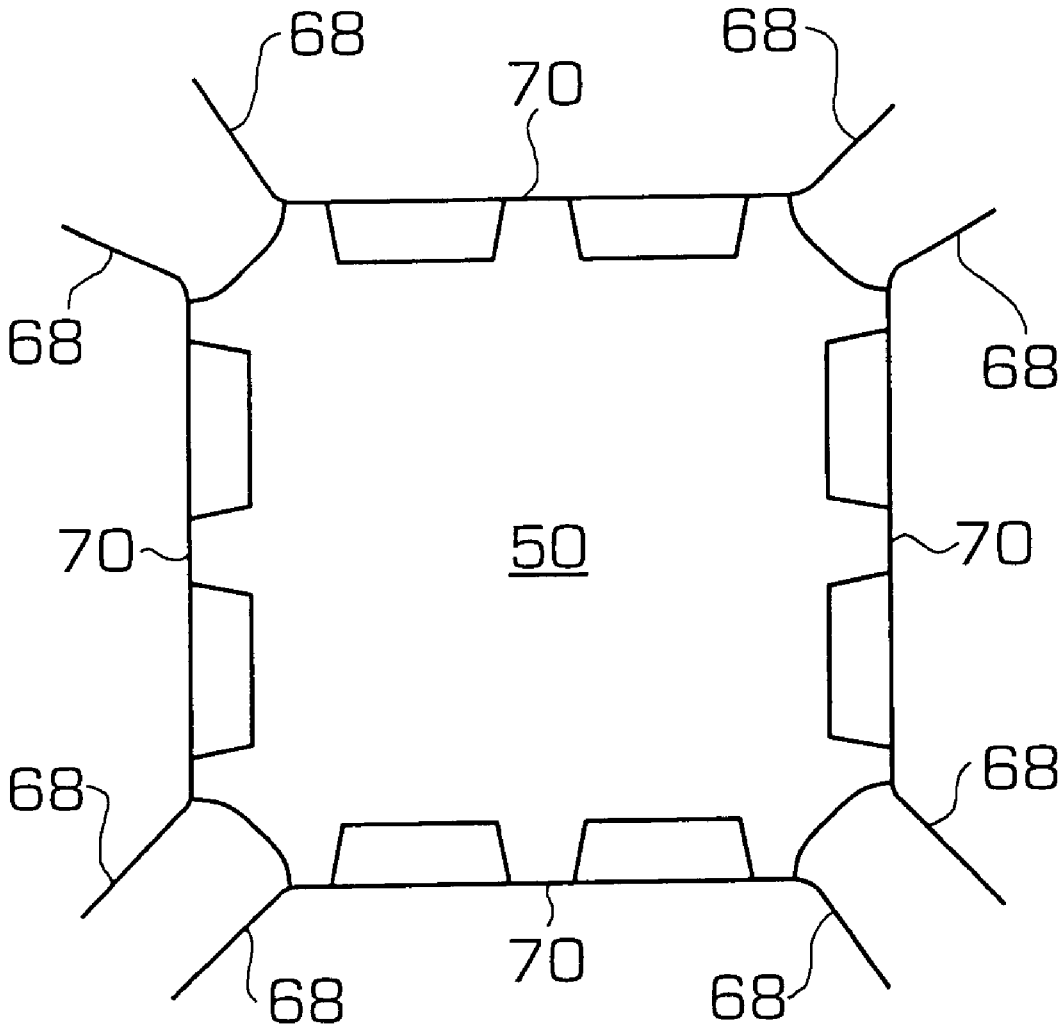
FIG. 5 is a top view of the second embodiment showing the candle holder completely folded.

FIG. 5 is a diagrammatic top view of candle holder 10 of FIG. 4 which has all four panels folded upwardly. Outboard branches 68 are schematically shown bent away from the periphery 70 of base 50.

We claim as our invention:

1. An apparatus, comprising:

a candle holder including a blank formed from a single sheet of metal and having a base; a plurality of panels; and a plurality of straps, at least one of said straps joining a respective one of said panels to said base enabling said panels to be folded into a substantially upright position by hand and remain in said position without additional reinforcement.

2. An apparatus as set forth in claim 1, wherein said base is adapted to receive a candle thereon.

3. An apparatus as set forth in claim 1, wherein said base is rectilinear in shape.

4. An apparatus as set forth in claim 1, wherein said plurality of panels comprises two side panels and two end panels so as to form a substantially cubical candle holder.

5. An apparatus as set forth in claim 1, wherein said panels include decorative cutouts shaped to resemble a building when said panels are in said substantially upright position.

6. An apparatus as set forth in claim 1, wherein said panels include decorative cutouts shaped to resemble a plurality of trees when said panels are in said substantially upright position.

7. An apparatus as set forth in claim 1, wherein said panels include at least one side edge and at least one slot located adjacent said side edge and oriented substantially parallel to said side edge; and said slot allowing said side edge to be outwardly bent by hand when said panel is in said substantially upright position.

8. An apparatus as set forth in claim 1, wherein said panels include peripheral shapes designed to resemble a thematic scene.

9. An apparatus as set forth in claim 8, wherein said panels further include cutouts shaped to resemble said thematic scene.

10. A method of forming a candle holder, comprising the steps of:

providing a flat blank;

stamping said blank to form a base, a plurality of panels and a plurality of straps joining said panels to said base, wherein said base, panels and straps constitute a single piece of metal after said blank is stamped; and folding said panels into a substantially upright position by hand, said stamped blank forming a candle holder when said panels are folded into said substantially upright position.

11. An apparatus comprising:

a candle holder formed from a stamped metal blank;

said blank including a square base having four edges;

said blank further including four panels;

said panels each having a lower edge, each of said lower edges being respectively adjacent to one of said edges of said base and oriented parallel thereto; and said blank further including at least one strap joining a respective one of said lower edges of said four panels to one of said edges of said base, said straps enabling said panels to be folded into a substantially upright position by hand and remain in said position without additional reinforcement.

12. An apparatus as set forth in claim 11, wherein said base is adapted to receive a candle thereon.

13. An apparatus as set forth in claim 11, wherein said panels are shaped to resemble a building when said panels are in said substantially upright position.

14. An apparatus as set forth in claim 11, wherein said panels are shaped to resemble a plurality of trees when said panels are in said substantially upright position.

15. An apparatus as set forth in claim 11, wherein said panels include at least one side edge and at least one slot located adjacent said side edge and oriented substantially parallel to said side edge, said slot being vertically oriented when said panels are in said upright position; and said slot allowing said side edge to be outwardly bent by hand when said panel is in said substantially upright position.

16. An apparatus as set forth in claim 11, wherein said panels include cutouts shaped to resemble a thematic scene.

17. An apparatus as set forth in claim 11, wherein said panels include peripheral shapes designed to resemble a thematic scene.

18. An apparatus, comprising:

a candle holder formed from a single, one-piece stamped, substantially planar metal blank having a base and a plurality of panels integrally connected to said base by a plurality of straps, the size of said blank and the thickness of said metal chosen to enable said blank to be shipped in a flat envelope, and assembled by bending said panels upwardly by hand.

19. An apparatus as claimed in claim 1, wherein said blank is no greater than 6 inches in height.

20. An apparatus as claimed in claim 19, wherein said blank is no greater than 6 inches in width.

21. The method of claim 10, wherein said step of folding said panels into a substantially upright position by hand comprises bending said straps.

22. An apparatus, comprising:

a candle holder having a base and a plurality of panels, said panels being joined to said base by straps, said base, panels, and straps all being integrally formed of a single piece of metal;

wherein said panels are foldable by hand with respect to said base by bending said straps; and said candle holder having a shipment position wherein said base and said panels are coplanar, and a candle-receiving position wherein said panels are folded upwardly relative to said base;

wherein said panels remain in said candle-receiving position without additional reinforcement.

23. An apparatus as claimed in claim 18, wherein said stamped blank will remain assembled without the need for any additional reinforcement.

* * * * *